United States Patent [19]

Danner et al.

[11] Patent Number: 4,624,370

[45] Date of Patent: Nov. 25, 1986

[54] VIBRATORY SEPARATION APPARATUS

[75] Inventors: Gary A. Danner; Raymond W. Sherman, both of Barrington, Ill.

[73] Assignee: General Kinematics Corporation, Barrington, Ill.

[21] Appl. No.: 589,651

[22] Filed: Mar. 14, 1984

[51] Int. Cl.[4] ..... B07B 7/00; B07C 5/38

[52] U.S. Cl. ..... 209/631; 209/34; 209/136; 209/635

[58] Field of Search ..... 209/44.2, 631, 634, 209/691, 639, 932, 34, 30, 35, 136, 137, 154, 312, 635, 644, 696, 151

[56] References Cited

U.S. PATENT DOCUMENTS

| | | | |
|---|---|---|---|
| 773,556 | 11/1904 | Fern | 209/639 |
| 1,306,870 | 6/1919 | Vaughn | 209/635 |
| 2,932,394 | 4/1960 | McGinn | 209/135 |
| 3,334,739 | 8/1967 | Jarvis | 209/136 |
| 3,612,271 | 10/1972 | Behling | 209/644 |
| 3,662,886 | 5/1972 | Kennedy, Jr. | 209/30 |
| 3,799,339 | 3/1974 | Breitholtz et al. | 209/639 |
| 4,293,408 | 10/1981 | Herder | 209/932 |
| 4,490,247 | 12/1984 | Forsberg et al. | 209/137 |

*Primary Examiner*—Robert B. Reeves
*Assistant Examiner*—Donald T. Hajec
*Attorney, Agent, or Firm*—Wood, Dalton, Phillips, Mason & Rowe

[57] ABSTRACT

A vibratory particle separation apparatus of the type having a two plateau conveying surface interrupted by a drop-out opening. A composite mixture is conveyed by a vibrating action beyond the upper plateau and over the drop-out opening. An air supply is directed angularly in relationship to the plane of the upper plateau and breaks apart the composite mixture and propels particles of a predetermined density and/or dimension to the landing area on the second level. In another aspect of the invention, the landing area is adjustable angularly with respect to the plane of the upper plateau of the conveying surface and is translatable to constrict or enlarge the dimensions of the drop-out opening. The particles passing through the drop-out opening and not intercepted by the landing area exit the system.

12 Claims, 8 Drawing Figures

VIBRATORY SEPARATION APPARATUS

BACKGROUND OF THE INVENTION

1. Field of the Invention

The present invention relates to vibratory apparatus and, more particularly, to an apparatus for controlled separation of a composite mixture by density and/or particle size.

2. Background Art

It is known to provide a vibratory conveying structure to separate composite mixtures including particles of different size and density. An exemplary use for such a structure is to separate accumulated materials in a wood yard. The composite mixture may include wood fiber, dirt, stones, steel and/or other materials that commonly are found around such an operation.

A typical prior system uses a vibrating trough to advance the composite mixture from a supply source to a discharge area. The flow path along the trough is interrupted by a drop-out opening. The composite mixture is directed from a first plateau across the drop-out opening so that the trajectory of certain of the particles is intercepted by a landing surface at the discharge side of the drop-out opening and beneath the elevation of the first plateau. A forced air supply is directed substantially parallel to the flow on the first plateau and propels additional low density particles onto the landing surface or second plateau. The more dense particles fall to the bottom of the structure for accumulation in a first area while the particles on the landing surface are conveyed to a second, separate area.

The air supply impinging on the particles falling off of the plateau into the drop-out opening has been generally ineffective in propelling the desired particles to the landing area. For example, the particles may be lodged together as clumps so that the force of the air stream is not sufficient to cause the particles to reach the landing area, though their individual weight dictates that they should follow the path of the low density material. As a result, an incomplete separation occurs. To attempt to break up the clumps, the air flow was increased with the result that heavy unwanted particles were propelled across the drop-out opening and onto the landing area.

Further, the prior structures have incorporated a landing area with a fixed dimension and orientation. Combining this shortcoming with a fixed drop-out opening severely limits the versatility of the apparatus. The dimensions of the drop-out opening and orientation of the landing must thus be chosen depending on one particular environment within which the apparatus is intended to be operated.

Also, the forced air supply systems in the prior structures have been generally unduly complicated.

The present invention is specifically directed to overcoming one or more of the above enumerated deficiencies known in the art.

SUMMARY OF THE INVENTION

The present invention is directed to an apparatus that is simply constructed for cost efficiency and which effects a clean separation of particles according to differences in densities, particle size and/or fluidizing properties.

The invention is adaptable to a known system of the type having a conveying plateau for directing a composite mixture to the edge of a drop-out opening and a landing surface at the discharge end of the drop-out opening for intercepting lower density materials. More specifically, an improved air supply system includes a duct disposed at an angle with respect to the upper plateau, which is normally in a horizontal orientation. The air supply impinging at the described angle rips the material bed apart at the drop-out opening in an improved manner and propels particles below a predetermined density onto the landing area. A majority of lighter particles will be carried over to the landing area with intermediate density and smaller high density particles landing on the landing plate. Cleaner particle separation results.

It is another aspect of the invention to provide an improved air supply system. For simplicity sake, a blower is mounted on a support surface that is separate from the supports for the conveyor. This facilitates connection of flexible air tubes between the blower and a pressure chamber. The pressure chamber communicates through a diffuser plate that serves simultaneously as a stiffener for the first plateau area above the angled duct.

To enhance the versatility of the system, the landing plate has a multi-dimensional adjusting capability. The landing plate, which is generally substantially flat, is adjustable angularly with respect to the first plateau and second plateau. The main function of the angle adjustment of the landing plate is to determine the angle that allows heavy density material to slide back to drop-out while the lighter material is conveyed forward.

The landing plate is further adjustable in the direction of flow to vary the dimension of the drop-out opening. By constricting the opening, larger particles will be intercepted and advanced toward the low density separation point. By using the two adjustments in combination, a wide range of separation parameters can be chosen.

The invention contemplates also the provision of a second separation stage including a second lower plateau, cooperating landing surface and forced air supply. The additional stage can be used redundantly with the first stage to more completely separate particles. The second stage, or any additional stage alternatively offers the possibility of separation according to three or more prescribed density ranges.

The invention includes a structure for initially separating the incoming composite mixture by size. The coarse material traverses one path with the finer material traversing a different path. One such structure being a perforated deck as part of the conveyor moving the incoming composite material to the initial drop-out zone. The finer material is combined with the heavy density material from the drop-out zone which is then further processed by a separate separation stage.

DETAILED DESCRIPTION OF THE DRAWINGS

Figure 1:
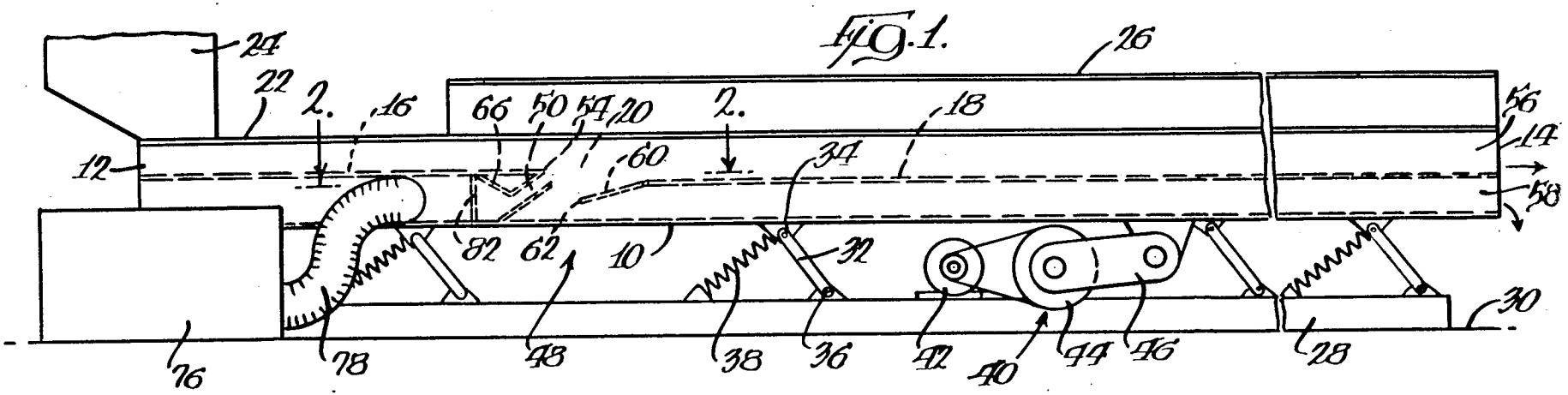
FIG. 1 is a sectional view of a vibratory separation system incorporating a preferred form of the invention.

An exemplary system to which the present invention is adaptable is illustrated in FIG. 1. The system comprises a trough 10 with an input end 12 and an open discharge end 14. The trough is divided into two horizontally disposed vertically spaced plateaus including an upper plateau 16 and a lower plateau 18 between which a drop-out opening 20 is defined.

The trough has an upwardly opening area 22 adjacent the input end to admit a composite mixture from a source of supply 24. A hood 26 encloses the trough 10 from the discharge end 14 to a point beyond the drop-out opening 20 to confine very light particles entrained in a forced air stream as described below.

The trough 10 is suspended for vibratory motion relative to a base 28, bearing against a support surface 30 for the system. A plurality of stabilizer links 32 interconnect the trough 10 and base 28. The links are arranged angularly with respect to the vertical, parallel to each other and each is pivotally connected at its upper end 34 with the trough and at its lower end 36 to the base. Reaction springs 38 act between the trough and base and are situated to make substantially a right angle with the stabilizer links 32. Although coil springs 38 are shown it is to be understood that leaf springs and/or resilient members could be used. The conveying apparatus may be any one of the well-known structures on the market.

The vibratory actuating means at 40 are conventional and consist generally of a base mounted motor 42 associated with an eccentric drive 44 which, through a link 46, imparts a controlled vibratory conveying motion to the trough.

Material moves ahead in the conveyor in a series of gentle throws and catches as a result of the controlled linear motion produced by the eccentric drive and stabilizer links. A coil spring reactor system is designed to match the resonant frequency to the eccentric drive speed. All of the forces required to decelerate and accelerate the trough are balanced by the forces developed by deflection of the coil spring reactors. The eccentric drive provides only the additional energy lost due to friction. Since each coil spring functions as an individual drive, all forces are uniformly distributed along the unit length.

Figure 2:
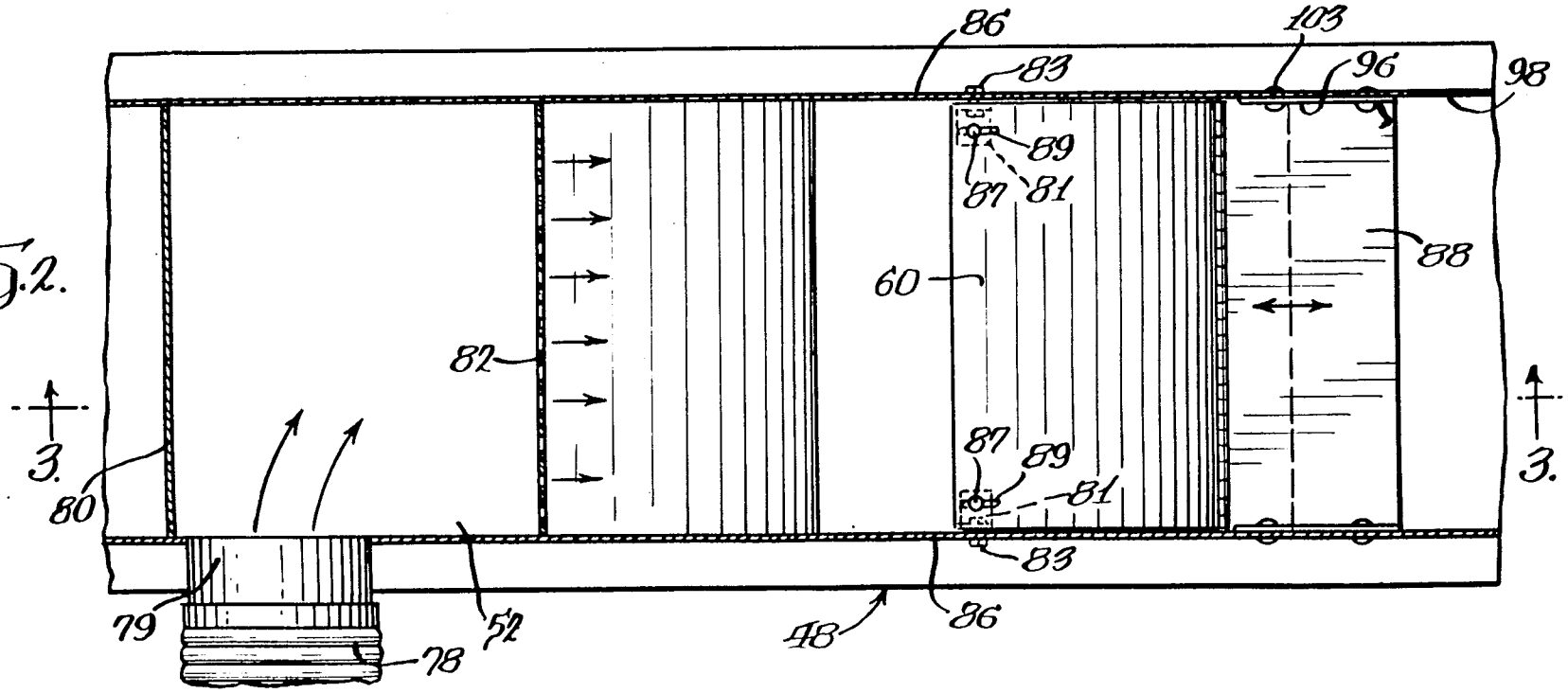
FIG. 2 is a sectional view of the main separation stage of the system along line 2—2 of FIG. 1.
Figure 3:
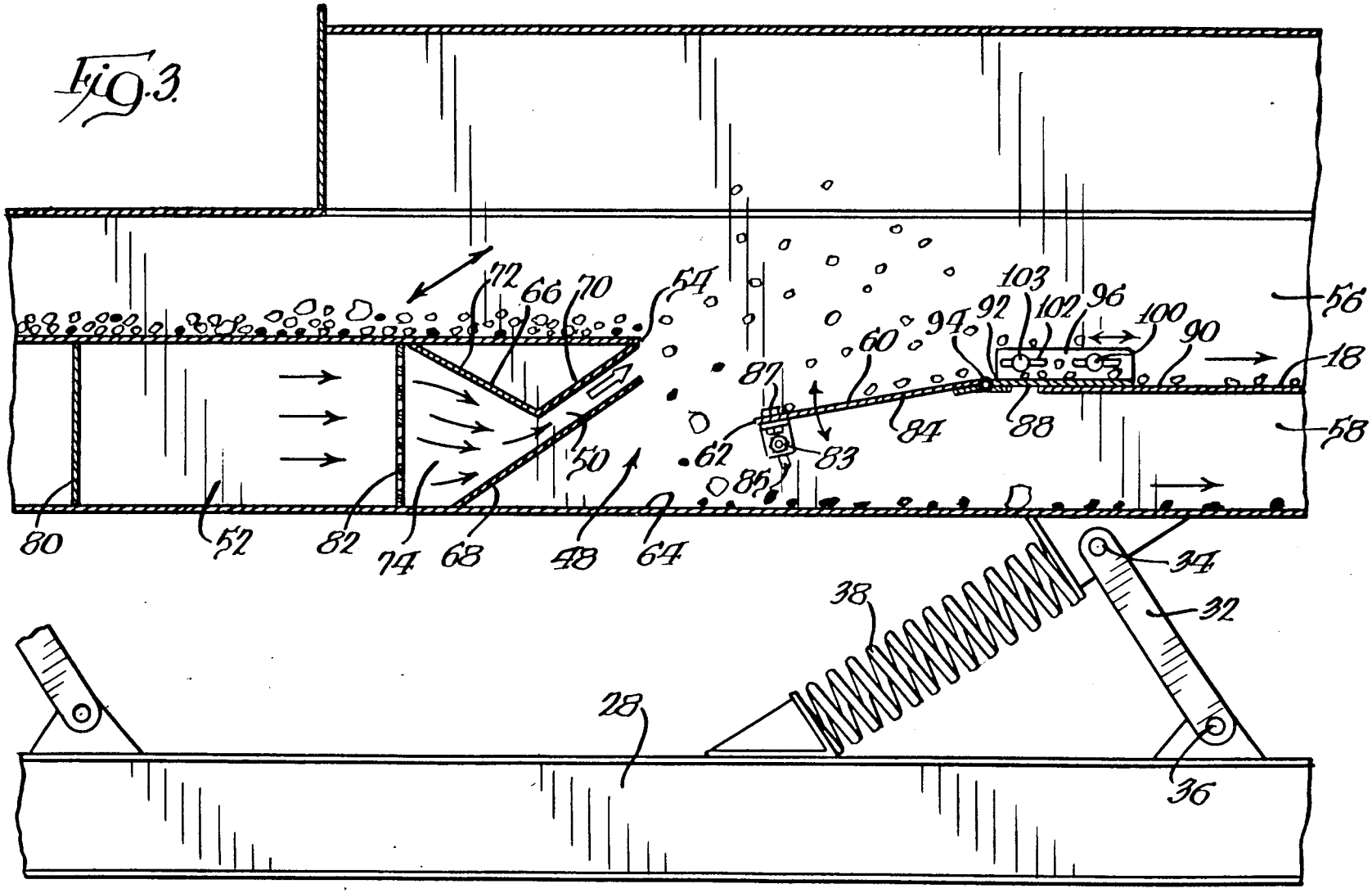
FIG. 3 is a sectional view of the main separation stage along line 3—3 of FIG. 2.

One aspect of the invention focuses on the primary separation stage indicated generally at 48 in FIGS. 1–3. According to the invention, a duct 50 causes air from a pressurized chamber 52 to impinge upon particles passing over the edge 54 of the upper plateau 16. The action of the air upon the particles is demonstrated in FIG. 3.

The lower plateau 18 separates the lower density collection area 56 from the higher density collection area 58. A landing area 60 bounds the drop-out opening and intercepts the lighter particles that are dislodged by the air and propelled sufficiently toward the discharge end to pass the free edge 62 of the landing area 60. The heavier particles fall over the edge 54 and accumulate at the bottom wall 64 of the trough 10 for collection and conveyance through the high density area 58.

To direct the air from the pressure chamber according to the present invention, a V-shaped baffle 66 is mounted beneath the upper plateau 16. A deflector plate 68 extends angularly upwardly from the bottom wall 64 of the trough 10 and runs parallel to one leg 70 of the V-shaped baffle 66. The other leg 72 of the baffle defines in conjunction with deflector plate 68 a converging opening 74 between the pressure box and duct 50.

To supply the pressure chamber, a remote blower 76 is mounted to the surface 30 separate from the apparatus. The blower communicates through a flexible conduit 78 with the inside of the pressure chamber. The conduit 78 can be readily attached and removed by reason of an end fitting 79 provided on the pressure chamber. The pressure chamber is bounded by the upper plateau 16, the bottom 64 of the trough, a partition 80 at the inlet side of the conveyor and a diffuser plate 82 that is perforate to admit air from the pressure chamber to the converging opening 74 feeding the duct 50. The diffuser plate 82 and legs 72 and 70 of the baffle 66 serve at the same time as a bearing support for the upper plateau 16.

It is another aspect of the invention to incorporate an adjusting capability into the landing area 60. To accomplish this, the lateral edges 84 of the landing area are unconnected to the side walls 86 of the trough 10. A flat slide plate 88 is provided and facially engages the upper surface 90 of the lower plateau 18. The edge 92 of the slide plate toward the inlet side is hingedly connected with the landing ramp 60 for pivoting movement about a laterally extending axis 94. A locking arrangement is provided between the landing area 60 and the slide plate 88 to lock the angle of the landing area relative to the slide plate 88. One such structure is shown in FIGS. 2 and 3. Support brackets 81 in the form of right angles are bolted to the inside surface of each wall 86 by bolts 83 passing through openings in the one leg of the bracket and into slots 85 in the walls 86. The brackets 81 are raised or lowered to raise or lower the outer end 62 of the landing plate 60. The brackets 81 are secured to the underside of the landing plate 60 by a bolt 87 on the underside of the plate passing into an elongate slot 89 in the horizontal leg of the brackets 81.

The slide plate 88 has integral, vertical flanges 96 which closely abut the inside surface 98 of the trough side walls 86. Apertures 100 are provided in the side wall 86 in parallel relationship to the plane of the plateau 18 and coincide with elongate guide slots 102 in the flanges 96 with the slide plate flushly against the upper surface 90. Bolts 103 are extended through the coinciding apertures and slots and allow translation of the slide plate including the pivotally attached landing ramp between the ends of the trough. The bolts can be secured to fix the position of the slide plate where desired. As the slide plate 88 is adjusted horizontally, the landing plate 60 adjusts relative to the brackets by the bolts 87 in slots 89 in brackets 81.

It can be seen that by adjusting the landing plate in a counterclockwise direction about pivot 94 any higher density particles that are intercepted by the landing plate will be carried in the opposite direction from the direction of movement of the less dense material and will fall off the landing plate onto the bottom wall 64 where they will be conveyed along with the other more dense material. More specifically, the vibratory conveyor is tuned to convey the material from left to right. The slope of the landing plate negates the conveying action of the more dense material on the landing plate causing it to be conveyed in a reverse direction, i.e. right to left. The less dense material still will move left to right toward the upper area 56. Graduated adjustments can be made to choose a desired line of separation.

By adjustably translating the landing ramp, the dimension of the drop-out opening in the direction of flow can be chosen. By enlarging the opening area, less dense and smaller sized particles will be intercepted by the landing ramp and routed to the lower density region 56. The two dimensional adjustment can be coordinated to sort out oversized and overdense particles by reverse flow as described above to arrive at the precise division of particles according to desired size and density.

Figures 4, 4A:
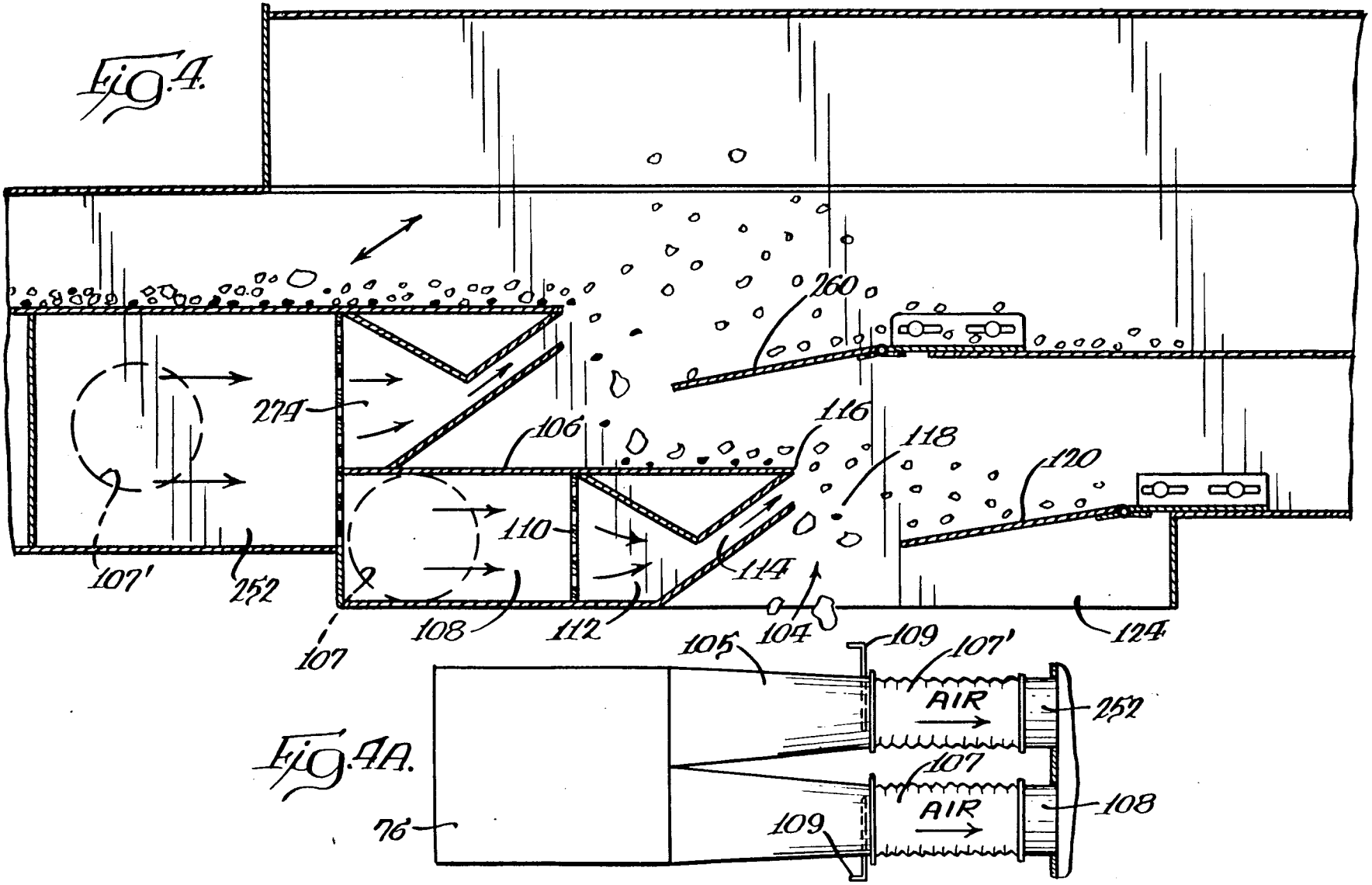
FIG. 4 is a sectional view of a modified structure according to the present invention including a second separation stage.
FIG. 4*a* is a schematic illustration of structure for generating air under pressure for the system.

A modification of the invention is shown in FIGS. 4 and 4*a*. The structure in FIG. 4 has an additional separation stage at 104 beneath the first stage and spaced toward the discharge end of the trough. The air supply from the fan 76 is divided (FIG. 4*a*) by a divider 105 at the fan outlet into two ducts 107,107' with slide gates 109 located in each duct to control the air flow into chambers 252 and 108. The chamber 108 communicates through a perforate diffusion wall 110 through a converging chamber 112 in the second stage with a duct 114 which is disposed at an angle to the third plateau 106 to break up the particles passing beyond the edge 116 and passing over a second stage drop-out opening 118.

The third plateau 106 cooperates with the air from duct 114 and the landing area 120 in the lower stage substantially as the first stage previously described in relation to FIG. 3. The lower and second stage 104 adds an additional dimension to the apparatus. The landing areas 260 and 120, respectively on the first and second stages, are independently adjustable to vary the dimension of the drop-out opening and the angle of the landing areas 260,120 in relationship to the respective plateau.

The embodiment illustrated in FIG. 4 discharges the particles from the lower stage out a bottom opening 124. Suitable collection or disposal can be accomplished in conventional manner. In operation, particles of a first size and/or density can be separated at the first stage, particles of a second size and/or density separated at the second stage and particles of a third size and/or density discharged through the bottom opening. Redundant separation might otherwise occur at the first and second stages for more complete separation.

Figure 5:
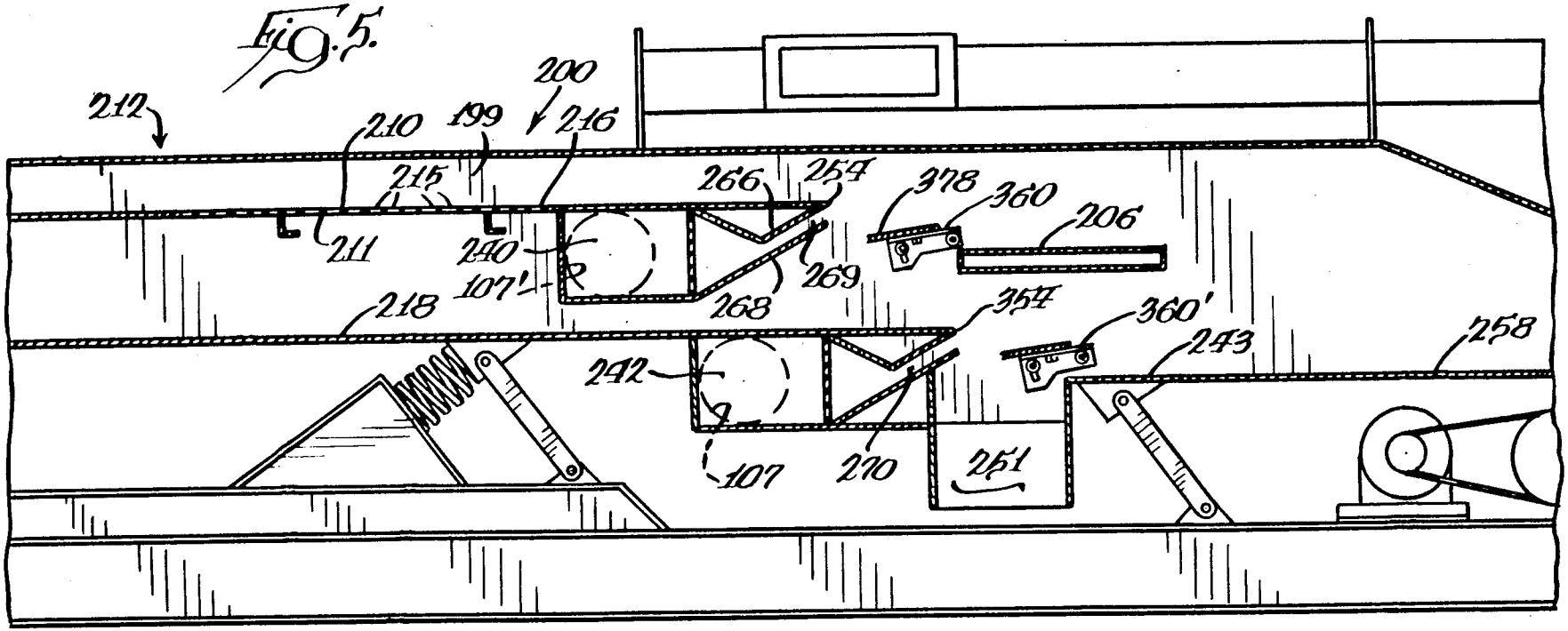
FIG. 5 is a sectional view of a second modified structure showing initial coarse and fine separation followed by a two stage separation system.
Figure 7:
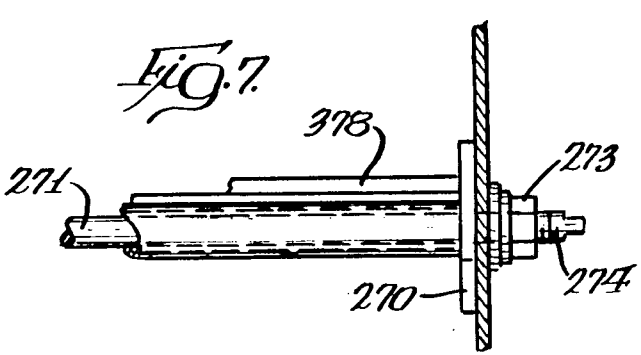
FIG. 7 is a partial elevational view of one end of the pivot rod for the landing plate of FIG. 6.
Figure 6:
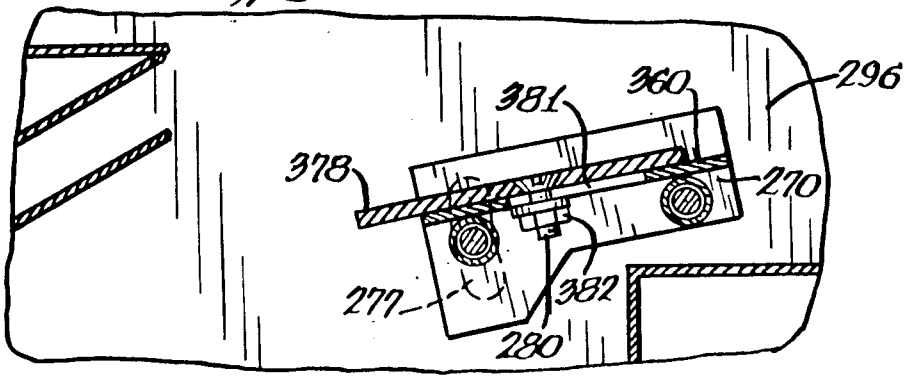
FIG. 6 is an enlarged view of one form of angle and gap adjusting structure for the landing plate.

An additional modification is shown in FIGS. 5, 6 and 7 wherein is illustrated a two stage separation apparatus employing an improved initial separation structure before the drop-out openings and an improved landing plate adjusting structure for adjusting the drop-out opening size and the landing plate angle.

The vibratory conveyor 200 has at an intermediate portion 199 adjacent an input end 212 of the trough 210 a perforated deck 211 with openings 215 of a particular size so as to pass particles of a particular size in the composite material therethrough. The trough 210 operates an upper plateau 216 with the small size particles falling through to a third lower plateau 218. The air supply from the fan 76 is divided in the same manner as shown in FIG. 4*a* with the air in duct 107' passing into a pressure chamber 240 (FIG. 5) and the air in duct 107 passing into pressure chamber 242. The pressure chamber 240 is supported on the side walls of the conveyor and supports the trough 210 as in FIG. 1, with the bottom wall 241 of the chamber 240 being spaced above the second lower plateau 218 so that the smaller sized particles can be conveyed beneath the chamber 240.

The pressure chamber 240 has V-shaped baffle 266 with a deflector plate 268 parallel to leg 270 of baffle 266 so that the air stream from chamber 240 exits at an angle to the horizontal from duct 269 and impinges upon the particles passing over edge 254 with the less dense particles being propelled onto the improved landing plate 360 and second plateau 206 as will be described in detail hereinafter. The more dense particles will land on the third plateau 218 to join with the smaller size particles from the perforated deck 211. The combined particles will be conveyed over the edge 354 where the separately controlled air stream from the pressure chamber 242 and angled exit duct 270 propels the less dense particles onto a second improved landing plate 360' and plateau 243, also as will be described hereinafter. The more dense material will drop-out of the system through exit opening 251. The material from the second plateau 206 will fall onto the fourth plateau 243 and be conveyed as usable product to the exit 258.

As shown in FIGS. 5, 6 and 7 a modified structure is shown for the landing plate 360 for adjusting the drop out opening and for adjusting the angle of the landing plate 360. The landing plate 360 has flanges 270 on each end of the plate. A pivot rod 271 passes through openings 272 in side walls 296 of the conveyor and is secured thereto by nuts 273 threaded on threaded ends 274. The other portion of the flanges 270 have openings 275 through which bolts 276 pass. The bolts extend into arcuate shaped slots 277 in the side walls 296 and are secured by nuts on the outside of wall 296. Loosening the nuts on the bolts 276 will permit the angle of the landing plate 360 to be changed. Mounted on the plate 360 is an extension 378 which is slidably adjustable toward and away from the pressure chamber 240. The slidable adjustment being effected by studs 280 on the undersurface of extension 378 engaging through slots 381 in plate 360 and being locked in place by nuts 382. The landing plate 360 structure is duplicated at 360', one being for the second plateau 206 and the other being for the fourth plateau 243.

The landing plate 360 associated with the second plateau 206 is spaced above the second plateau 206 and is in fact relatively short in length relative to the plateau. The angle of the landing plate 360 is set and the extension 378 is properly adjusted for the size of particles to be received by the second plateau 206. The air stream from pressure chamber 240 is such that it propels and scatters the particles so that the less dense fly over the landing plate 360 and land directly on the second plateau 206. The more dense particles land on the landing plate 360 and due to the angle of the plate and the extent of vibratory motion will separate the less dense particles which will be conveyed forward and dropped onto the second plateau 206 with the more dense particles dropping back onto the third plateau 218 to join the particles from the perforated plate 211 and the previously dropped more dense particles from the first plateau 216.

The second landing plate 360' is adjusted the same way as the first landing plate 360 but at an angle and with the size of the drop-out opening being selected for the separation desired at this level in the apparatus. The landing plate 360' receives material propelled from the edge 354 by the air stream from pressure chamber 242. The least dense material is propelled onto the fourth plateau 243 with slightly more dense material landing on the landing plate 360' where it is separated into less dense material which is conveyed to the fourth plateau 243 with the more dense falling off the extension 378 into the discharge 251 along with the more dense material that did not get propelled to the second landing plate 360'.

The material from the second plateau 206 may fall onto the fourth plateau 243 as the vibratory conveyor moves the material toward the discharge of the selected material at exit 258.

The separate pressure chambers 240 and 242 each have controls for varying the extent of the air streams issuing from the passages below edges 254 and 354. In this way the density of the material desired to be separated is selected so that the air stream will separate and scatter the desired material onto the landing plates 360,360' and plateaus 206 and 243.

The embodiment shown in FIGS. 5, 6 and 7 incorporates many variables to accomplish a most unique end result. That is, the perforated plate 211 initially separates small particles from the composite material, the small particles falling onto the third plateau 218. The initial composite material without the separated smalls is subjected to the angled air stream with the less dense material being propelled to the second plateau 206, with the intermediate dense material falling on the landing plate 360 of the second plateau 206 where it is separated into more dense and less dense particles with the more dense particles falling in the drop-out area with the dense material from the composite material. The material in the dropout area falls onto the third plateau 218 with the small particles separated by the perforated plate. The combined smalls and dense material passes over the second air stream where the least dense material is propelled to the fourth plateau 243 with the intermediate dense material landing on the landing plate 360 for separation into less dense and more dense particles. The more dense particles falling back out the drop-out opening for discharge together with the heavy particles that were not propelled to the landing plate of the fourth plateau 243.

It should be understood that the landing plate 360 adjusting structure and spacing above its plateau 206 of FIGS. 5, 6 and 7 could be used in the two plateau structure of FIGS. 1–3 and the three plateau structure of FIG. 4.

It should be understood that the foregoing description was made for purposes of clarifying the structure and operation of the invention, with no unnecessary limitations to be derived therefrom.

We claim:

1. An improved vibratory separating apparatus of the type having a conveying surface for moving a composite mixture in a conveying direction between an inlet end and a discharge end and having a first conveying plateau and a second conveying plateau spaced from the first plateau toward the discharge end and a drop-out opening between the first and second plateaus, said first plateau directing the composite mixture substantially along a plane adjacent the drop-out opening and having an edge at the drop-out opening, said second plateau having a landing area including at least a portion spaced beneath the edge of the first plateau, the landing area including a planar surface and an edge bounding the drop-out opening, and means for vibrating said conveying surface to effect vibrating movement of the composite mixture, the improvement comprising:

means for directing air from a pressurized air source angularly with respect to the plane of direction of particles on the first plateau so as to enhance breakup of the composite material and cause materials of a predetermined size and density over the drop-out opening to be propelled to the landing area on the second plateau for conveyance to a first area, whereby materials of a size and density other than those of said predetermined size and density pass through the drop-out opening for separate collection;

means for translating at least a portion of the landing area selectively in the conveying direction to enlarge the drop-out opening and oppositely to the conveying direction to diminish the area of the drop-out opening;

means to adjust the angular position of the planar landing area and to thereby adjust the relative vertical position of the edge of the second plateau and the first plateau to permit selective control of the nature of the material reaching the second plateau; and a pressurized air source, said source of pressurized air comprising a pressure chamber and blower means communicating with a converging chamber through said pressure chamber, said directing means comprising a duct having walls defining a flow path that is angled with respect to the plane of direction of particles on the first plateau and communicating between the converging chamber and the drop-out-opening.

2. The improved vibratory separating apparatus of claim 1 wherein said blower means are mounted on a surface separate from said vibratory apparatus so as not to vibrate therewith and means removably connecting a conduit between the pressure chamber and the blower means.

3. An improved vibratory separating apparatus of the type having a conveying surface for moving a composite mixture in a conveying direction between an inlet end and a discharge end and having a first conveying plateau and a second conveying plateau spaced from the first plateau toward the discharge end and a drop-out opening between the first and second plateaus, said first plateau directing the composite mixture substantially along a plane adjacent the drop-out opening and having an edge at the drop-out opening, said second plateau having a landing area including at least a portion spaced beneath the edge of the first plateau, and means for vibrating said conveying surface to effect vibrating movement of the composite mixture, in combination with a pressurized air source, the improvement comprising:

said source of pressurized air comprising a pressure chamber and blower means communicating with a converging chamber through said pressure chamber;

means for directing air from the pressurized air source angularly with respect to the plane of direction of particles on the first plateau so as to enhance breakup of the composite material and cause materials of a Predetermined size and density over the drop-out opening to be propelled to the landing area on the second plateau for conveyance to a first area;

whereby materials of a size and density other than those of said predetermined size and density pass through the drop-out opening for separate collection;

said directing means comprising a duct having walls defining a flow path that is angled with respect to the plane of direction of movement of particles on the first plateau and communicating between the converging chamber and the drop-out opening;

means for translating at least a portion of the second plateau selectively in the conveying direction to enlarge the drop-out opening and oppositely to the conveying direction to diminish the area of the drop-out opening; and a V-shaped baffle mounted beneath the first plateau and having a surface defining a portion of the converging chamber and another surface that defines one of the duct walls.

4. An improved vibratory separating apparatus of the type having a conveying surface for moving a composite mixture in a conveying direction between an inlet end and a discharge end and having a first conveying plateau and a second conveying plateau spaced from the first plateau toward the discharge end and a drop-out opening between the first and second plateaus, said first plateau directing the composite mixture substantially along a plane adjacent to the drop-out opening and having an edge at the drop-out opening, said second plateau having a landing area including at least a portion spaced beneath the edge of the first plateau, and means for vibrating said conveying surface to effect vibrating movement of the composite mixture, in combination with a pressurized air source, the improvement comprising:

said source of pressurized air comprising a pressure chamber and blower means communicating with a converging chamber through said pressure chamber;

means for directing air from the pressurized air source angularly with respect to the plane of direction of movement of particles on the first plateau so as to enhance breakup of the composite material and cause materials of a predetermined size and density over the drop-out opening to be propelled to the landing area on the second plateau for conveyance to a first area, whereby materials of a size and density other than those of said predetermined size and density pass through the drop-out opening for separate collection;

said directing means comprising a duct having walls defining a flow path that is angled with respect to the plane of direction of particles on the first plateau and communicating between the converging chamber and the drop-out opening;

means for translating at least a portion of the second plateau selectively in the conveying direction to enlarge the drop-out opening and oppositely to the conveying direction to diminish the area of the drop-out opening; and a perforate diffusion wall between the pressure chamber and the converging chamber, said wall bearing upwardly against the first plateau to rigidify the first plateau.

5. An improved vibratory separating apparatus of the type having a conveying surface for moving a composite mixture between an inlet end and a discharge end and having a first conveying plateau and a second conveying plateau spaced from the first plateau toward the discharge end and drop-out opening between the first and second plateaus, said first plateau directing the composite mixture substantially along a plane adjacent the drop-out opening and having an edge at the drop-out opening, said second plateau having a landing area including at least a portion spaced lower than the edge of the first plateau, and means for vibrating said conveying surface to effect vibrating movement of the composite mixture, the improvement comprising:

means for directing air from a pressurized air source angularly with respect to the plane of direction of particles on the first plateau so as to enhance breakup of the composite material and cause materials of a predetermined size and density over the drop-out opening to be propelled to the landing area on the second plateau for conveyance to a first area;

a third plateau below the first plateau and terminating beyond the drop-out opening of the first plateau;

means on the first plateau for separating smaller sized particles from the composite material and dropping the smaller particles onto the third plateau; and means for directing air from a second pressurized air source angularly with respect to the plane of direction of particles on the third plateau to cause materials of a predetermined size and density to be propelled over a drop-out opening at the end of the third plateau and to land onto a fourth plateau for conveyance to said first area;

whereby materials other than those of said predetermined size and density that are propelled over the drop-out opening between the first and second plateaus, pass through the drop-out opening between the first and second plateaus and materials other than those of said predetermined size and density that are propelled over the drop-out opening between the third and fourth plateaus, pass through the drop-out opening between the third and fourth plateaus.

6. An improved vibratory separating apparatus as claimed in claim 5 wherein said landing area on said second plateau is a first landing plate pivoted at one end on said apparatus, the other end of the plate being vertically adjustable to adjust the angle of the plate so that the propelled material when landing on the angled plate will be separated by vibratory movement into less dense material which will move forward and more dense material which will be conveyed back and fall in the dropout opening.

7. An improved vibratory separating apparatus as claimed in claim 6 wherein said fourth plateau has a landing area having at least a portion spaced lower than the edge of the third plateau and wherein said landing area on said fourth plateau is a second landing plate pivoted at one end and adjustable at the other end to adjust the angle of the plate.

8. An improved vibratory separating apparatus as claimed in claim 7 wherein said first and second landing plates each have an extension adjustably mounted thereon and means for adjusting each extension relative to its landing plate to vary the horizontal space between the first and second plateaus and between the third and fourth plateaus.

9. An improved vibratory separating apparatus as claimed in claim 7 wherein the pivoted end of said second landing plate on the fourth plateau is spaced above the fourth plateau so that some of the particles propelled from the third plateau will land on the second landing plate and some on the fourth plateau.

10. An improved vibratory separating apparatus as claimed in claim 6 wherein the pivoted end of said first landing plate is spaced above the second plateau.

11. An improved vibratory separating apparatus as claimed in claim 5 wherein means are provided for varying the pressure of the air stream issuing from each pressurized air source so as to provide for the desired density of particles to be separated.

12. An improved vibratory separating apparatus as claimed in claim 5 wherein said means on the first plateau for separating the small sized particles comprise openings of a predetermined size formed through the deck of the trough of the first plateau whereby particles of the appropriate size will fall through the openings and onto the third plateau wherein the appropriate sized particles are conveyed to beneath the dropout opening between the first and second plateaus.

* * * * *